United States Patent [19]

Greiner et al.

[11] Patent Number: 4,522,181

[45] Date of Patent: Jun. 11, 1985

[54] FUEL INJECTION PUMP FOR INTERNAL COMBUSTION ENGINES

[75] Inventors: Max Greiner, Gerlingen; Karl Konrath, Ludwigsburg, both of Fed. Rep. of Germany

[73] Assignee: Robert Bosch GmbH, Stuttgart, Fed. Rep. of Germany

[21] Appl. No.: 608,632

[22] Filed: May 9, 1984

Related U.S. Application Data

[62] Division of Ser. No. 410,668, Aug. 23, 1982, Pat. No. 4,475,521.

[30] Foreign Application Priority Data

Sep. 29, 1981 [DE] Fed. Rep. of Germany ..... 3138606

[51] Int. Cl.³ ..... F02M 59/20

[52] U.S. Cl. ..... 123/502; 123/387; 123/380; 123/569

[58] Field of Search ..... 123/502, 501, 464, 465, 123/387, 380, 382, 383, 568, 569

[56] References Cited

U.S. PATENT DOCUMENTS

| | | | |
|---|---|---|---|
| 4,228,773 | 10/1980 | Stumpp et al. | 123/459 |
| 4,273,090 | 6/1981 | Hofer et al. | 123/502 |
| 4,334,514 | 6/1982 | Konrath et al. | 123/502 |
| 4,366,795 | 1/1983 | Laufer | 123/502 |
| 4,430,974 | 2/1984 | Bofinger et al. | 123/502 |

FOREIGN PATENT DOCUMENTS

| | | | |
|---|---|---|---|
| 2057165 | 3/1981 | United Kingdom | 123/502 |
| 2056716 | 3/1981 | United Kingdom | 123/502 |
| 2057720 | 4/1981 | United Kingdom | 123/502 |

*Primary Examiner*—Magdalen Y. C. Moy
*Attorney, Agent, or Firm*—Edwin E. Greigg

[57] ABSTRACT

A fuel injection pump for internal combustion engines is proposed which has a hydraulic injection instant adjuster, which is exposed to an rpm-dependent pressure established with the aid of a pressure control valve. The control of the pressure control valve is effected by means of varying the control pressure acting upon it. This is accomplished with the aid of a pressure valve, which has a slide exposed to a force variable in accordance with altitude, and the control pressure of the pressure control valve can be modified by means of this slide.

4 Claims, 6 Drawing Figures

FIG. 4
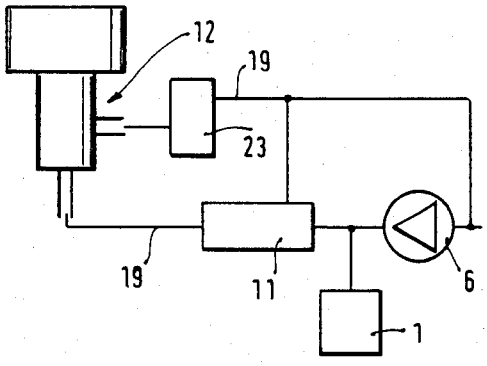
FIG. 5
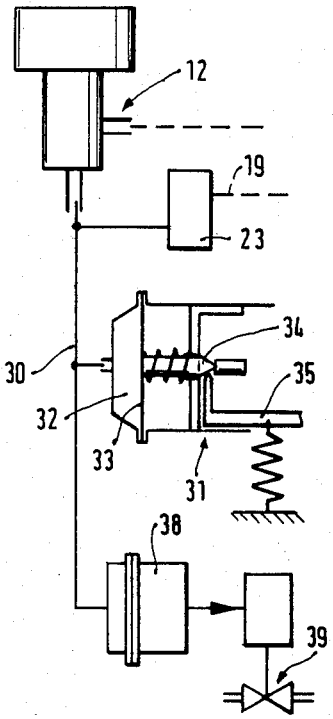
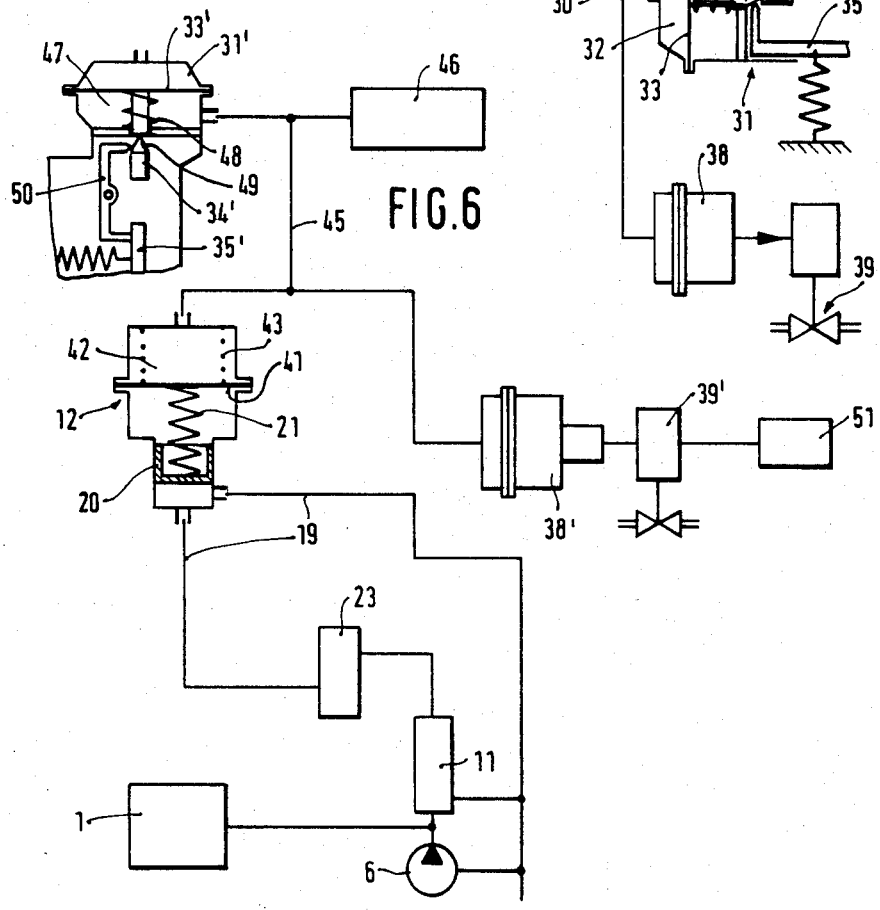
FIG. 6

FUEL INJECTION PUMP FOR INTERNAL COMBUSTION ENGINES

This application is a division of application Ser. No. 410,668, filed Aug. 23, 1982 and now U.S. Pat. No. 4,475,521.

BACKGROUND OF THE INVENTION

The invention is based on a fuel injection pump as revealed hereinafter. In a known fuel injection pump of this type, the control of the pressure exerted upon the control piston is effected with the aid of a pressure valve, the closing member of which is a ball and is stressed by a spring, the initial stress of which is variable in accordance with the ambient pressure. This embodiment has the disadvantage that upon the opening of the cross section closed by the ball pressure, fluctuations occur particularly at small flowthrough quantities, which affect the precise control of the pressure acting upon the control piston.

OBJECT AND SUMMARY OF THE INVENTION

The fuel injection accordingly has the advantage over the prior art that precise control of the pressure exerted on the control piston is obtainable in a simple manner.

A further advantageous embodiment in accordance with the invention is based on the general type of fuel injection pump but in which the valve closing member of the pressure valve is particularly embodied as a slide element, and in addition a temperature-controlled pressure maintenance valve is disposed between the control piston and the relief chamber in series with the pressure valve. Also, as further modified, a control line branches off from the pressure line between the pressure maintenance valve and the pressure valve, leading to an adjusting device for a load-limitation stop of the fuel injection pump or to an exhaust recirculation quantity adjusting device. With this device, one advantageously obtains both an adaptation of the injection onset to the variation in altitude level and a shift of the injection onset toward "early" during cold starting. At the same time, according to a still further embodiment, the air pressure which drops at high altitude can be taken into consideration in measuring the fuel injection quantity, advantageously in combination with the correspondingly adapted control of the exhaust recirculation rate. In a particularly advantageous manner, the control pressure exerted upon the control piston is thus simultaneously used for a plurality of corrective actions.

Advantageous further embodiments of and improvements to the fuel injection pump disclosed herein are attained by means of the characteristics disclosed more particularly in the specification.

The invention will be better understood and further objects and advantages thereof will become more apparent from the ensuing detailed description of five preferred embodiments taken in conjunction with the drawings

BRIEF DESCRIPTION OF THE DRAWINGS

FIG. 4 shows a third exemplary embodiment of the invention having a modified form of the embodiment of FIG. 3;

FIG. 5 shows a fourth exemplary embodiment having an embodiment like that of FIG. 3 but with its function expanded in scope;

FIG. 6 shows a fifth exemplary embodiment having a pressure control valve controlled by reference pressure.

DESCRIPTION OF THE EXEMPLARY EMBODIMENT

Figure 1:
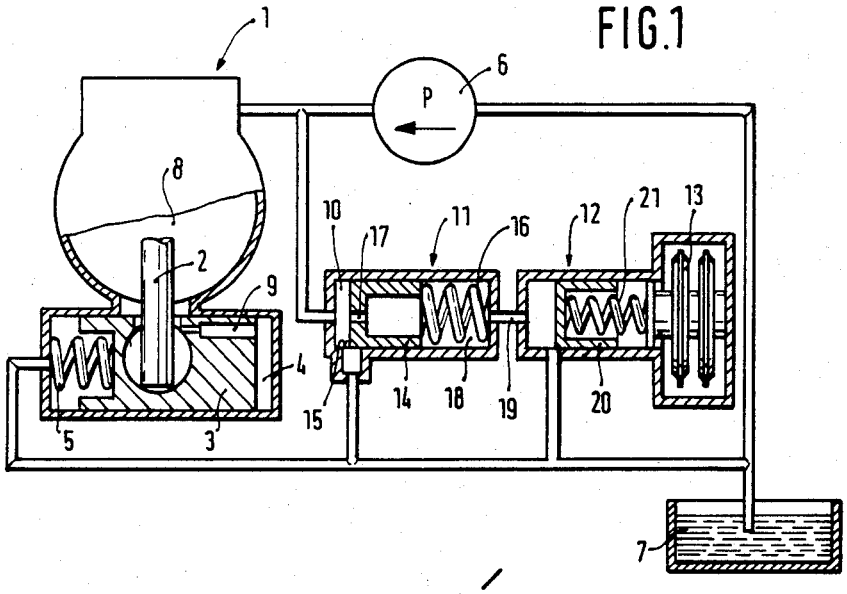
FIG. 1 shows a first exemplary embodiment, having a pressure valve controlled by means of a barometric box.

Turning now to the drawing in FIG. 1, an adjusting piston 3 engages the cam drive of a fuel injection pump 1 via a pin 2 for adjusting the instant of the onset of injection. The adjusting piston 3 is displaceable counter to a restoring spring 5 by the pressure fluid located in a work chamber 4. The farther the piston is displaced toward the spring, the earlier the instant of injection is shifted with respect to the top dead center position of the piston. A supply pump 6 aspirates fuel from a fuel container 7 and pumps it into a suction chamber 8 of the injection pump 1, from which (not shown in detail) the actual fuel injection pump is supplied with fuel and which communicates via a bore 9 in the adjusting piston 3 with the work chamber 4. The supply pressure of the supply pump 6 and thus the pressure in the suction chamber 8 are controlled in accordance with rpm via a pressure control valve 11, the pressure increasing in proportion with the increasing rpm. This rpm-dependent pressure thus prevails in the work chamber 4 as well, so that with increasing rpm and thus increasing pressure, the injection adjusting piston 3 is shifted toward "early".

Figure 2:
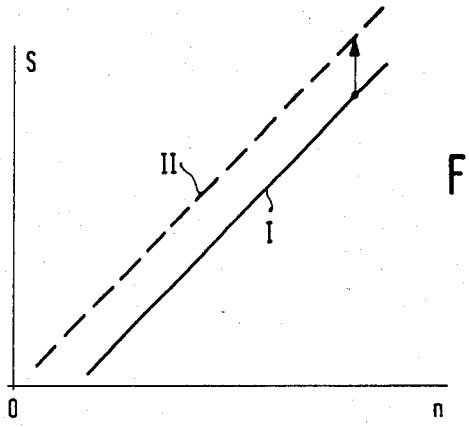
FIG. 2 is a functional diagram for the exemplary embodiment of FIG. 1.

In FIG. 2 a diagram is given in which the stroke s of the adjusting piston is plotted on the ordinate over the rpm n on the abscissa. The characteristic curve I indicates the course of injection adjustment, for which the stroke and thus the adjustment toward early increases linearly with the rpm. Curve II extends parallel to it and its corresponding course of the injection onset would be required if the engine would be operated at a relatively high altitude.

In accordance with the invention, this is attained in that the pressure in the suction chamber 8 and thus in the work chamber 4 is influenced via a pressure valve 12, which is controllable via a barometric box 13. The pressure control valve 11 has a control piston 14, with which a discharge opening 15 branching off from the pressure chamber 10 ahead of the control piston 14 can be controlled, and which control piston 14 is displaceable toward a control spring 16 by the fuel pumped by the fuel pump 6. The control piston 14 has a throttle bore 17, by means of which the pressure chamber 10 on one end of the control piston 14 communicates with a control pressure 18 on its other end. The control pressure chamber 18 which receives the control spring 16 has a relief line 19 in which the pressure valve 12 is disposed. The pressure valve 12 in turn has a slide 20 as its valve member, which controls a flowthrough cross section of the relief line 19 and is engaged by a valve spring 21. On the side remote from the slide 20 the valve spring 21 is supported on the barometric box 13, which here comprises two diaphragms and by way of which the initial stress of the valve spring 21 is variable. The function of this disposition is such that a pressure approximately at sea level, the valve spring 21 is substantially relaxed, and the slide 20 accordingly has opened the flowthrough cross section of the relief line 19 virtually completely. The pressure control valve 11 accordingly operates virtually unaffected by other elements, a constant fuel quantity flowing over the throttle 17. Now as soon as the engine, for instance, in a motor vehicle, arrives at a different altitude range, that is, as soon as the ambient pressure drops, the valve spring 21 is initially stressed to a greater extent because of the relaxing function of the barometric box, and a resistance is presented to the discharge of fuel in the relief line 19. This resistance causes an increase of pressure in the control pressure chamber 18 and thus in turn increases the pressure in the suction chamber 8 of the injection pump or in the work chamber 4 of the pressure control valve, as a result of which a variation of the injection onset toward "early" takes place. The use of a slide as the valve closing member for the pressure valve 12 here enables a very precise adjustment of the pressure in the control pressure chamber 18, so that the altitude-dependent shift in the injection onset very precisely follows the varying air pressure.

Figure 3:
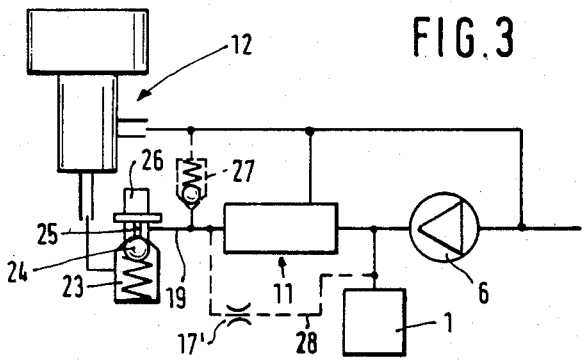
FIG. 3 shows a second exemplary embodiment, a modification of the exemplary embodiment of FIG. 1 having an additional thermostatically controlled pressure maintenance valve disposed in series between the pressure valve and the pressure control valve.

In the exemplary embodiment of FIG. 3, a pressure maintenance valve 23 is inserted into the relief line 19 between the pressure control valve 11 and the pressure valve 12, the pressure maintenance valve 23 being thermostatically controlled. This valve can be designed in a known form of embodiment such that a pin 25 which is actuated by a thermostat 26 acts upon the spring-loaded closing member in the opening direction. The thermostat may be heated either via an electrical heating resistor or directly by the coolant of the engine. Depending upon how far the valve closing member 24 is raised from its seat by the pin 25 counter to the force of the restoring spring, more or less fuel is capable of flowing through to the pressure valve. When the engine is at operational temperature, the pressure maintenance valve 23 is opened, so that the function of the pressure control valve 11 is unaffected. When the engine is cold, the relief line 19 is closed by the valve 23, so that a pressure builds up in the control pressure chamber 18 in accordance with the valve 23, and the adjusting piston is displaced in the direction of early injection onset.

In order to limit the pressure when the pressure valves 23 and 12 are closed, a pressure limiting valve 27 may additionally be provided between the pressure maintenance valve 23 and the pressure control valve 11, the pressure limiting valve 27 being arranged to prevent an excessively high control pressure in the chamber 18. This pressure limiting valve effects relief directly toward the relief point. As a result the shift of injection onset can be limited beyond a predetermined altitude.

If the pressure maintenance valve 23 is fully opened when the engine is at operational temperature, communication is established between the pressure control valve 11 and the pressure valve 12. The fuel then flowing out via the relief line 19 is the fuel which flows through the throttle 17 into the control pressure chamber 18 of the pressure control valve. This throttle 17 may also be disposed, in the form of a throttle 17', in a separate connecting line 28 leading from the relief line 19 to the pressure side of the supply pump 6.

FIG. 4 shows that the pressure maintenance valve 23 can also be disposed downstream of the pressure valve 12 in series in the relief line 19.

FIG. 5 is substantially identical in structure to the exemplary embodiment of FIG. 3. The difference here is that a control line 30 leading to an adjusting device 31 branches off from the relief line 19 between the pressure maintenance valve 23 and the pressure control valve 12. This adjusting device 31 has a pressure chamber 32 enclosed within a housing, and the control line 30 discharges into this pressure chamber 32. One side of the pressure chamber 32 is closed with a movable wall, for instance a diaphragm 33, which acts upon an adjustable stop 34 for a quantity adjusting member 35 of the fuel injection pump. To this end the adjustable stop 34 has a shaped contour, and it has the function of a load-limiting stop, for instance, a full-load stop, which limits the maximum fuel-injection quantity capable of being established at the fuel-injection pump. A compensating spring 36 acts upon the diaphragm 33 counter to the control pressure and is supported on the housing. In this manner, the maximum fuel injection quantity can be adapted to the ambient pressure simultaneously with the adjustment of injection onset in an advantageous manner.

In addition to this adjusting device 31, a second adjusting device 38 is provided, which is similar in structure and controls an exhaust gas recirculation valve 39. Here again, the exhaust gas recirculation rate can be reduced in accordance with altitude. The actuation of the exhaust gas recirculation valve may be effected with auxiliary force, using pneumatic, hydraulic or electric motor means, the second adjusting device 38 controlling these means.

The exemplary embodiment of FIG. 6 is basically the same in structure as the exemplary embodiment in FIG. 5 except that the pressure valve 12' and the first adjusting device 31' and the second adjusting device 38' are modified in their design. The pressure valve 12', like the pressure valve 12, has a slide 20 which controls the flowthrough cross section of the relief line 19. This slide 20 is furthermore stressed by the valve spring 21, but the spring is supported in this case by a movable wall 41, for instance a diaphragm. The diaphragm thereby tightly encloses a reference pressure chamber 42 in the housing of the pressure valve. The side of the diaphragm located opposite the reference pressure chamber is exposed to the ambient atmospheric pressure. The diaphragm is furthermore stressed by a compensating spring 43 disposed in the reference pressure chamber 42.

The reference pressure chamber communicates by means of the control pressure line 45 with a reference pressure source 46, which furnishes constant reference pressure.

In the case where the atmospheric pressure is varying, the diaphragm 41 is then deflected to a greater or lesser extent, so that the valve spring 21 is initially stressed to a greater or lesser extent and the pressure acting upon the control piston 14 of the pressure control valve 12 is accordingly varied together with the pressure in the suction chamber of the fuel injection pump. With declining pressure altitude, the interior pressure of the fuel injection pump is thus increased and as a result the injection onset is shifted in turn toward early by the adjusting piston.

A reference pressure chamber 47 in the adjusting device 31' further communicates with the control pressure line 45. This reference pressure chamber is tightly enclosed by a movable wall 33' in the housing of the adjusting device, and opposite the movable wall 33, atmospheric pressure prevails. A second compensating spring 48 is furthermore fastened within the reference pressure chamber 47, between the movable wall 33' and the housing of the adjusting device 31'.

As in the exemplary embodiment of FIG. 5 an adjustable stop 34' is connected with the movable wall 33' here and has a shaped contour 49. An intermediate lever 50 cooperates with this cone 49 and acts in turn as a stop for the quantity adjusting member 35' of the fuel injection pump. The intermediate lever 50 is centrally supported and transmits the contour scanning point, which varies with the displacement of the adjustable stop 34', to the quantity adjusting member 35.

As in the exemplary embodiment of FIG. 5 a second adjusting device 38' is also provided, which is again connected with the control pressure line 45 and controls an exhaust recirculation valve 39'. This valve may be actuated, as discussed earlier, by means of an auxiliary force 51. The adjusting device is basically the same in structure as the adjusting device 31' or the pressure valve 12.

In this exemplary embodiment as well, an adaptation of the full-load injection quantity and of the exhaust gas recirculation quantity to pressure conditions of the surroundings can be effected simultaneously with the shift in injection onset. At the same time, an injection onset adjustment toward early during cold starting is assured by the valve 23.

Intervening in the metering of fuel quantity via the adjusting device 31 or 31' can thus be effected both in the form of limiting full-load quantity and in the form of varying the fuel-quantity over the entire operational range.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines comprising a fuel supply pump driven in synchronism with the fuel injection pump, a pressure side of said fuel supply pump arranged to communicate with a work chamber ahead of an adusting piston, said adjusting piston serves to adjust the injection onset and is exposed to a restoring force in a chamber connected via a discharge line to a discharge opening, said discharge opening being controlled by a control piston of a pressure control valve including a relief chamber in order to generate an rpm-dependent control pressure at the pressure side of said pressure control valve, said control piston being exposed to a restoring force and further arranged to enclose on one side a control pressure chamber, said control pressure chamber being in communication with said pressure side of said fuel supply pump via a throttle connection and with said relief chamber via a relief line connected with a pressure valve including a housing, a valve closing member which is exposed to a valve spring, the initial stress of said valve spring being variable by means of a support point which is displaceable in accordance with air pressure, in which said valve closing member of said pressure valve comprises a slide means, and a control line branches off from said relief line between a pressure maintenance valve and said pressure valve, said control line leading to an adjusting device for adjusting a fuel injection quantity and to a further adjusting device for affecting an exhaust gas recirculation quantity.

2. A fuel injection pump as defined by claim 1, characterized in that said pressure valve further includes a reference pressure chamber enclosed in the housing of said pressure valve and connected to a reference pressure source, one side of said reference pressure chamber being closed by a movable adjusting member and the other side thereof being exposed to atmospheric pressure and in operative connection with said valve spring of said pressure valve in order to effect an initial stress.

3. A fuel injection pump as defined by claim 2, characterized in that said reference pressure chamber of said pressure valve is in parallel relation to a second reference pressure chamber which is closed off with respect to the atmosphere with a second movable adjusting member stressed by a second control spring, said second reference chamber being connected to said reference pressure source and further said second movable adjusting member is in operative connection with said adjusting device of the fuel injection quantity of said fuel injection pump.

4. A fuel injection pump as defined by claim 3, characterized in that parallel to said reference pressure chamber of said pressure valve, a third reference pressure chamber of said further adjusting device for the exhaust gas recirculation quantity metering communicates with said reference pressure source.

* * * * *